US005290125A

United States Patent [19]

Trevisani

[11] Patent Number: 5,290,125

[45] Date of Patent: Mar. 1, 1994

[54] TUNNEL LINING METHOD AND APPARATUS SUITABLE FOR THE PURPOSE

[75] Inventor: Davide Trevisani, Cesena, Italy

[73] Assignee: Trevi S.p.A., Ceseno, Italy

[21] Appl. No.: 958,511

[22] Filed: Oct. 8, 1992

[30] Foreign Application Priority Data

Oct. 25, 1991 [IT] Italy ..... TO91A000805

[51] Int. Cl.[5] ..... E21D 11/10

[52] U.S. Cl. ..... 405/140; 405/146; 405/150.1

[58] Field of Search ..... 405/140, 141, 146, 150.1, 405/138, 132

[56] References Cited

U.S. PATENT DOCUMENTS

| | | | |
|---|---|---|---|
| 3,407,609 | 10/1968 | Kosogorin | 405/140 |
| 3,413,811 | 12/1968 | Giacobino | 405/140 |
| 5,129,764 | 7/1992 | Casagrande | 405/140 X |
| 5,152,638 | 10/1992 | Trevisani | 405/140 |

FOREIGN PATENT DOCUMENTS

| | | |
|---|---|---|
| 3446A/89 | 4/1989 | Italy . |
| 2-57292 | 11/1991 | Japan . |

OTHER PUBLICATIONS

English language abstract of Italian Patent Application No. 3446A/89.

*Primary Examiner*—Dennis L. Taylor

*Attorney, Agent, or Firm*—Merchant & Gould, Smith, Edell, Welter & Schmidt

[57] ABSTRACT

In a tunnel lining method an apparatus, comprising at least one excavation tool of the chain, belt or band type or the like, is positioned to coincide with the longitudinal axis of the tunnel at a point on its extrados; the tool is made to advance to a predetermined depth in a direction diverging from the tunnel axis so as to create a substantially rectangular cavity from which the tool is withdrawn; said cavity is then filled with concrete to form a cast segment; the aforesaid stages are repeated until a frusto-conical section formed from adjacent cast segments is completed, after which the material within the formed section is excavated to a depth less than the axial length of the section, and the apparatus is advanced through a distance substantially equal to the axial length of the cast segments, the stages being repeated to form each successive section in order to form a lining in which the wider final portion of one section is superposed on the narrower initial portion of the next section; during the execution of one section of cast segments a second tool associated with said first tool executes consolidation/tamping injections with concrete or the like into the region which is to constitute said next section.

5 Claims, 10 Drawing Sheets

TUNNEL LINING METHOD AND APPARATUS SUITABLE FOR THE PURPOSE

The invention relates to improvements in a method for forming the final lining of a tunnel before excavation without the need for temporary work and under conditions of maximum personnel safety, and to apparatus suitable for the purpose.

The main object of the invention is to establish the stages of operation and to provide apparatus which, in the shortest possible time, at the least cost and with full respect for safety, enable tunnels to be constructed with a plurality of adjacent cast segments along the extrados, which form a frusto-conical calotte executed in advance of the excavation face.

A further object of the invention is to provide a whole series of operations and hence apparatus for executing possible supplementary reinforcement and/or consolidation work, by means of which the tunnel vault can be constructed by the adjacent cast segment system even in difficult terrain subject to landslip, collapse etc.

A further object of the present invention is to apply the adjacent cast segment system to the widening of existing tunnels, while still allowing a certain traffic throughput, even if limited or discontinuous.

The invention represents an improvement in the subject matter of patent application No. 3445 A/89 of Apr. 28, 1989 in the name of the present applicant, which describes a tunnel construction method using the adjacent cast segment system as the definitive operation for forming the vault or its circular or multi-centre cross-section.

The practical implementation of the method described in said patent application and the construction of the apparatus have highlighted a series of further operations which may be required, and have defined a particular form of apparatus. They have also demonstrated the possibility of widening existing tunnels.

These objects are attained by the method and apparatus of the following characteristics:

a) a self-propelled apparatus for constructing a tunnel of circular or multi-centre cross-section, which is fixed to or rests against the wall of that part of the tunnel which has been previously constructed;

b) and which in addition to enabling the adjacent cast segments to be formed in advance of the excavation face, also enables tamping injections of material based on hydraulic binders, possibly of high penetration type, to be made in positions corresponding with the cast segments of the section following that in which excavation of the earth enclosed by the previous cast segments is underway;

c) and further enables possible plugging to be formed (by injecting material possibly based on hydraulic binders of high penetration) at the working face of the section following that in which excavation between the previous cast segments is underway;

d) and if necessary enabling the laying, in correspondence with these latter borings, of tubes of glass-reinforced fibre or equivalent material for "stitching" the earth to be removed;

e) and, by means of the perimetral fixings of point a), enabling a considerable thrust on the cutters to be achieved, and the drive means (crawler-tracks) to be removed from the transit plane to allow the positioning of a debris collection tray and a system comprising a conveyor belt or the like to remove the debris;

f) and comprising a further apparatus which enables tunnels to be constructed of the open vault type with an inverted arch to be formed subsequently;

g) and a further apparatus of special execution which enables existing tunnels to be widened;

h) the apparatus of the two preceding points comprising a guide in the form of an arch on which the cutter moves, and which is fixed to the non-yieldable floor of "open" tunnels or of already existing tunnels to be widened, this being a case in which the road subgrade, the inverted arch and the existing services are maintained and the tunnel is kept in operation, even if with limited traffic and possibly with just one lane.

Further characteristics and advantages of the invention will be more apparent from the description of some preferred but non-limiting embodiments thereof given hereinafter with reference to the accompanying drawings in which.

Figure 1:
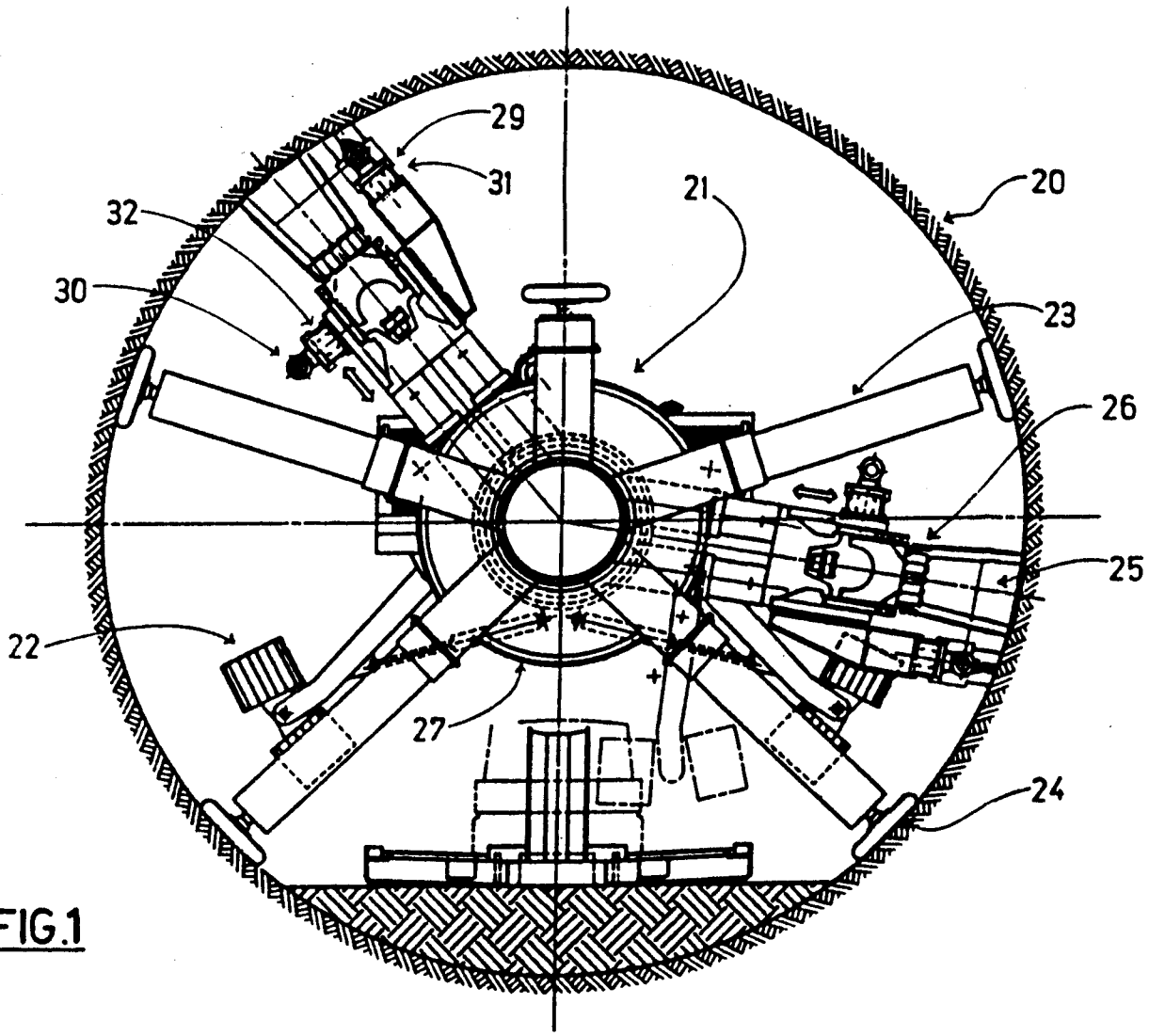
FIG. 1 is a front view of the apparatus for forming a tunnel of circular or multi-centre cross-section.

With reference to FIGS. 1 to 7, for constructing a tunnel of circular or multi-centre cross-section an apparatus 20 is used which forms the entire self-supporting lining. It comprises a main structure 20, the axis of which coincides with the tunnel axis.

The apparatus 20 is driven by crawler-track systems 22 which are then retracted and shifted to leave the passage free for the material loading and positioning vehicles comprising debris collection belts.

The entire apparatus is supported stationarily by telescopic arms 23 arranged radially to enable the apparatus to be fixed to the wall 24 of the already formed tunnel portion.

The apparatus is provided with two or more heads comprising cutters for forming the cast segments as described in the said patent application No. 3446 A/89. Said cutters 25 are positioned on arms 26 operated radially via thrust bearings 27 by way of telescopic supports 28.

On their sides, the arms 26 carry drilling heads 29 and 30 mounted on respective skids 31 and 32, to drill by rotopercussion or other methods, and insert a recoverable drill stem with a disposable shoe, to then inject into the face to consolidate, through the hollow drill stem during its extraction. The injection mixtures can be of the type based on hydraulic binders, possibly with high penetration. Any laying of glass fibre-reinforced plastic tubes or the like is done during this operation through the drill stem.

Figure 2:
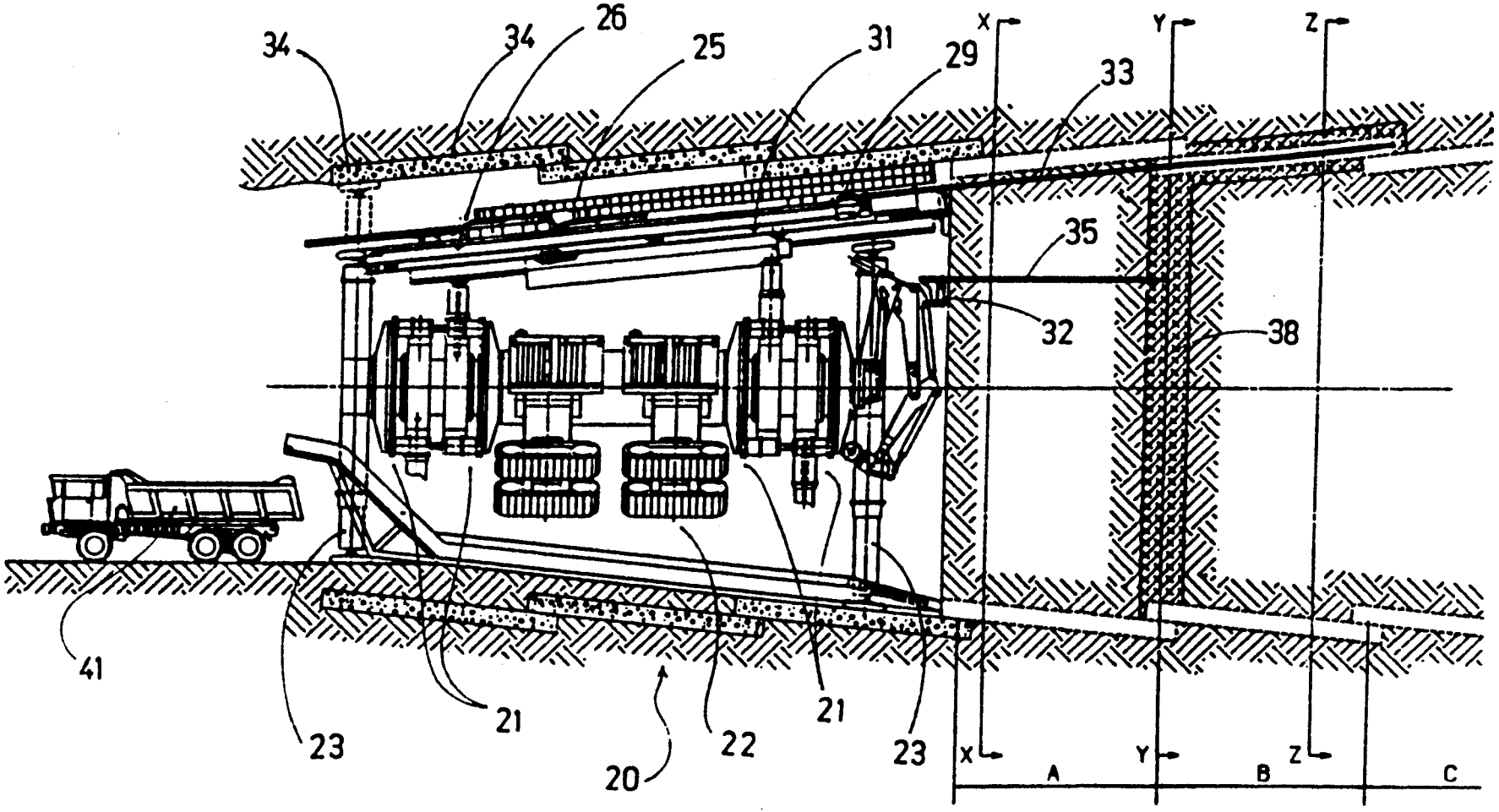
FIG. 2 is a longitudinal view of the apparatus of FIG. 1 during one working stage.
Figure 3:
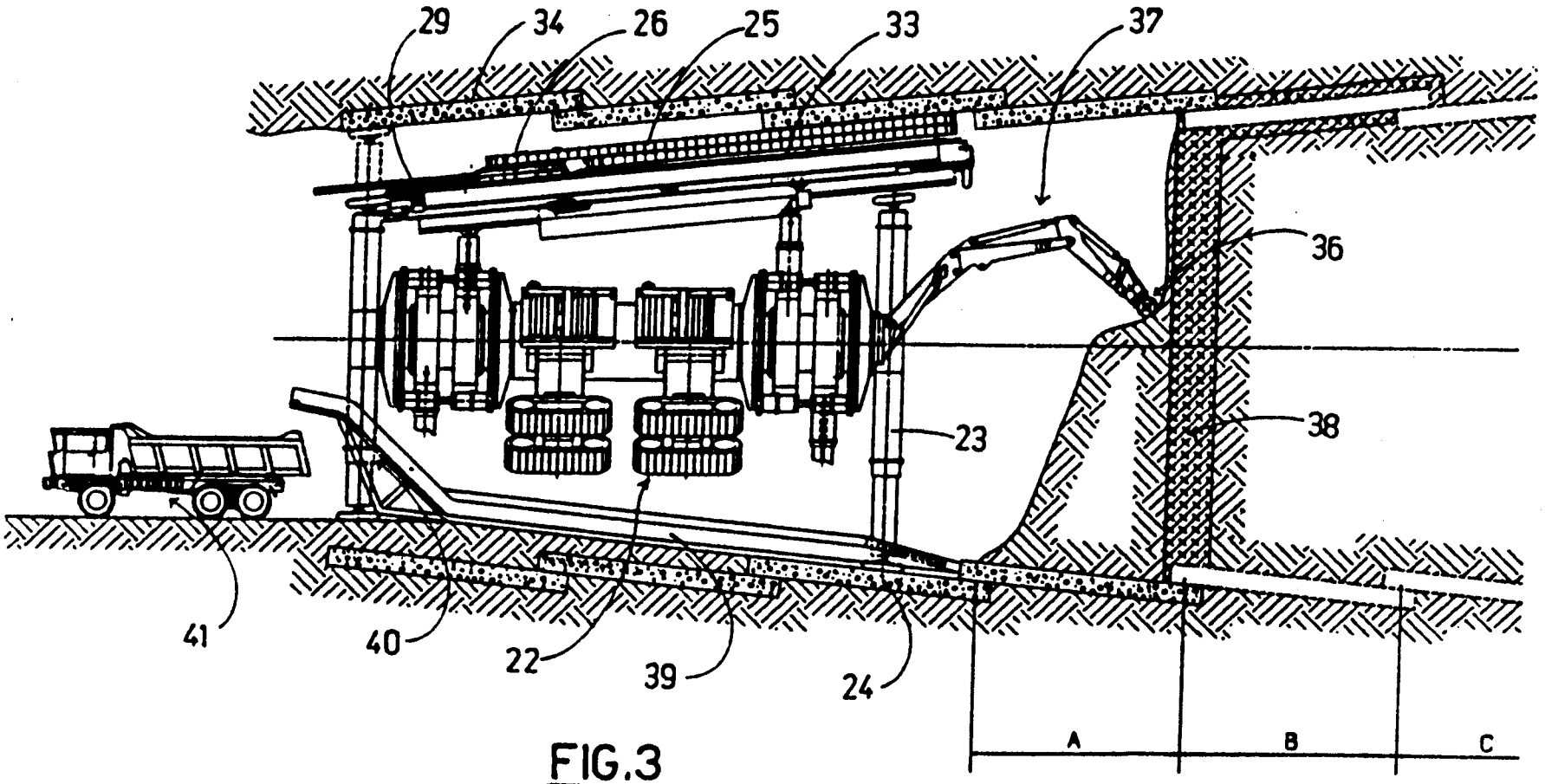
FIGS. 3 and 4 show further working stages subsequent to FIG. 2.
Figure 4:
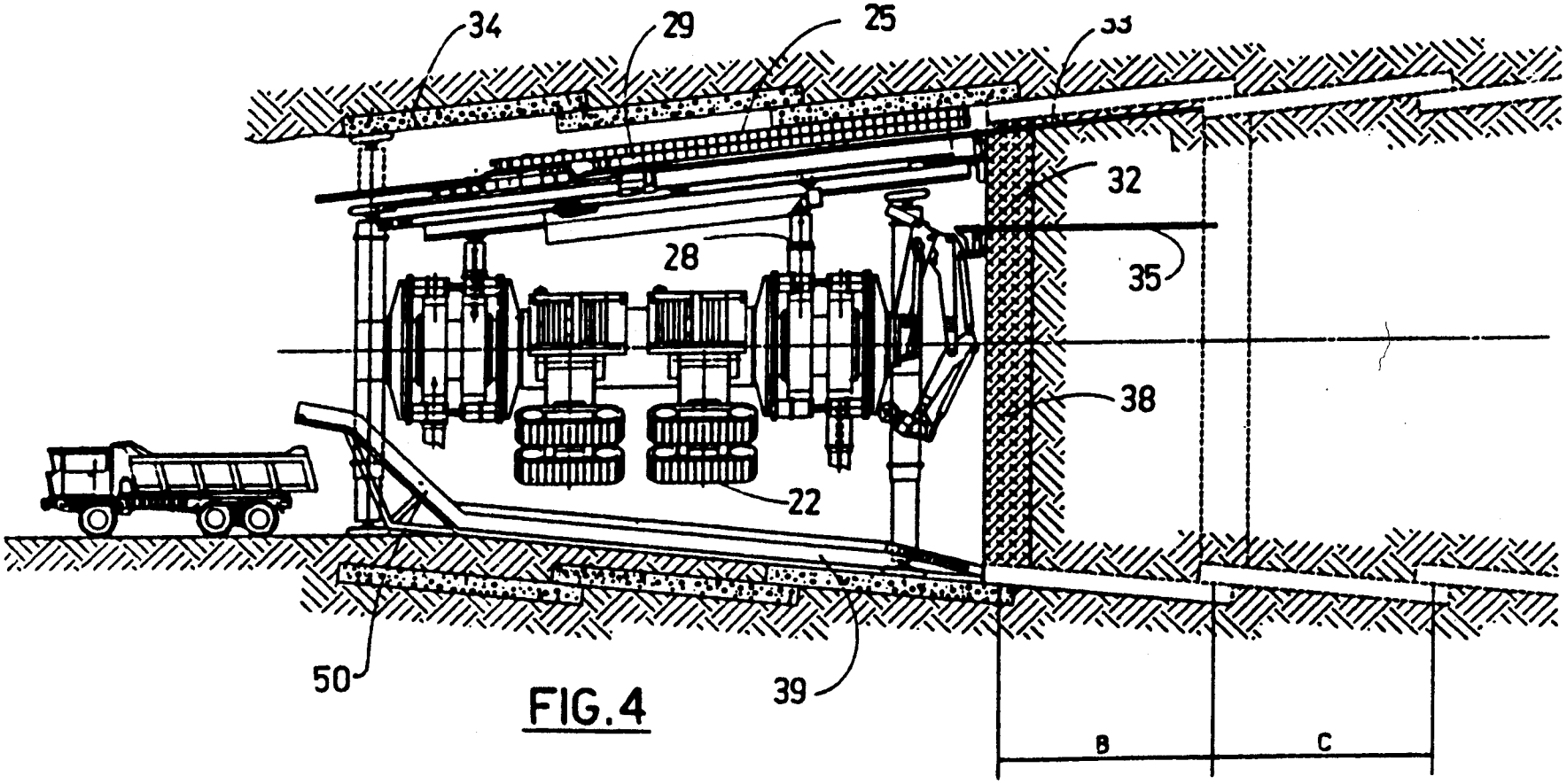

The operating stages can be followed from FIGS. 2, 3 and 4. While the cutter or cutters 25 form the cast segments 34 in the section A, the rod 33 operated by the head 29 injects tamping into what will become the next cast segment section B. Simultaneously, the rod 35 operated by the head 30 (FIG. 1) injects tamping into the face of the core separating the end of the section A from the beginning of the section B. As already stated, if necessary these tamping/consolidation injections can be supplemented with stitching tubes in the case of the core.

FIG. 3 shows the operation of the excavation tool 36 driven by an arm 37 to excavate the core section A. The material removal stops at the consolidated core plug 39 at the beginning of section B. The resultant material is loaded onto the tray 39 and the conveyor belt 40 transfers it to the transport vehicle 41. FIG. 4 again shows the stage illustrated in FIG. 2, i.e. the formation of the cast segments of section B, the tamping under the cast segment arch of section C, and tamping of the core face 39 at the beginning of section C.

Figure 6:
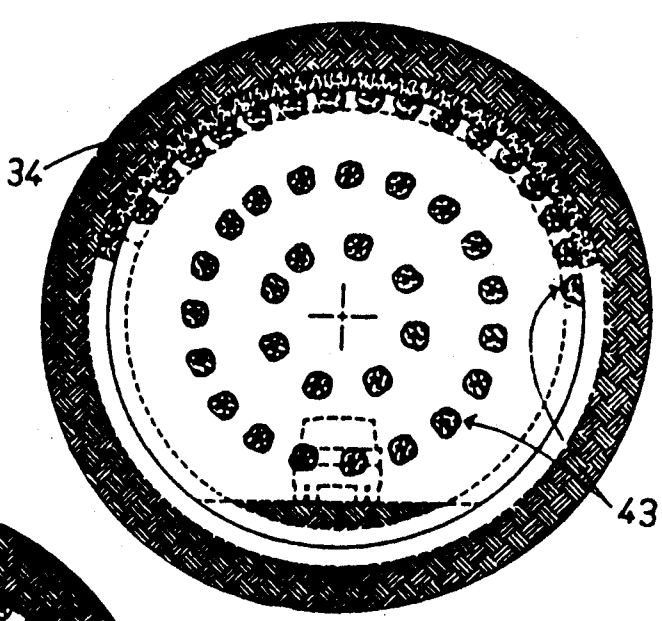
FIGS. 5, 6 and 7 are sections on the lines XX, YY and ZZ of FIG. 2 showing respectively the cast segments and the consolidation/tamping injections in the subsequent cast segment and core regions.
Figure 7:
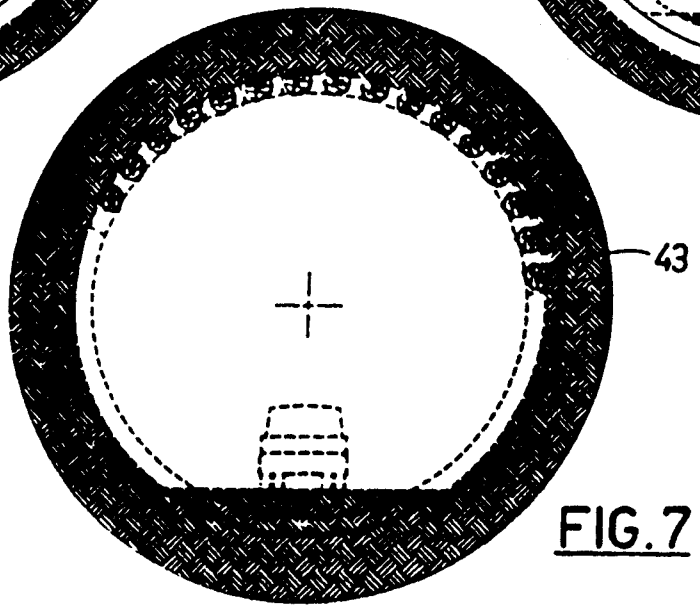
Figure 5:
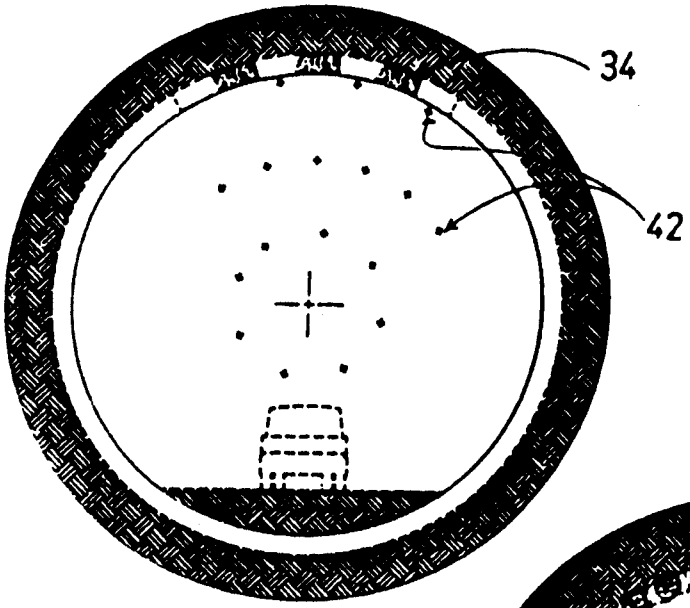
Figure 8:
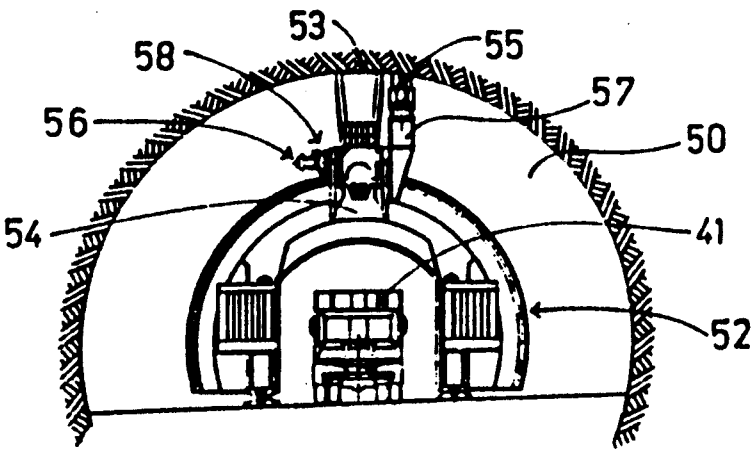
FIG. 8 is a front view of the apparatus for forming an "open" tunnel with inverted arch to be formed subsequently.
Figure 10:
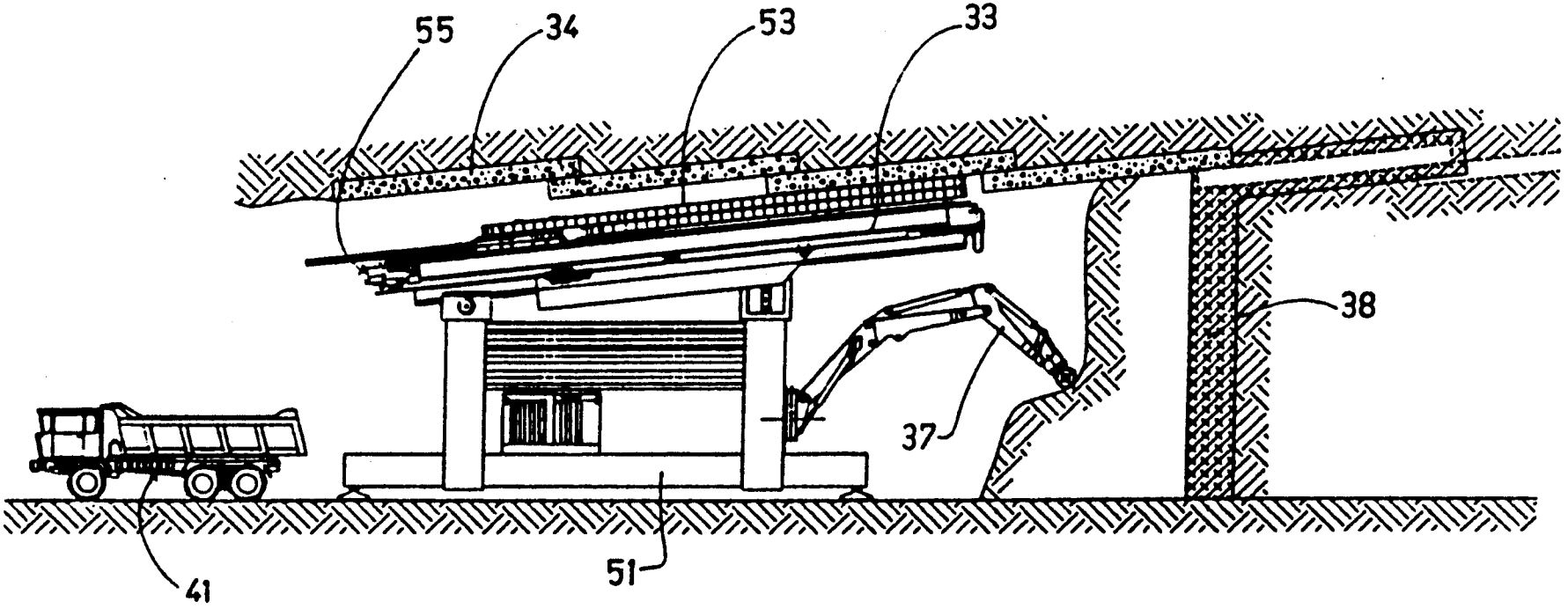
FIGS. 10 and 11 show further working stages subsequent to FIG. 9.
Figure 11:
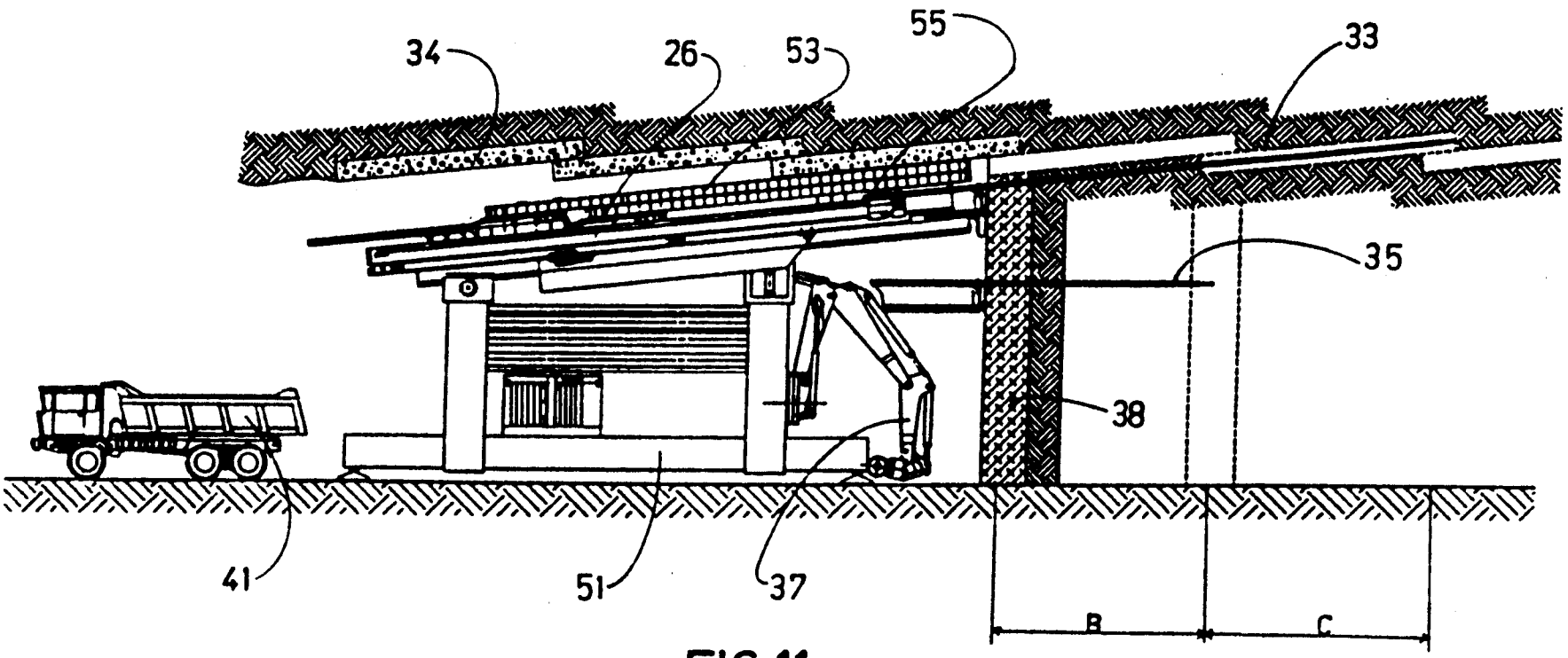

For greater clarity, FIGS. 5, 6 and 8 represent respectively:

- a cross-section on the line XX of FIG. 2 showing the formation of the cast segments 34 of the section A and the bores 42 through which the drilling rods 35 pass for consolidation/tamping of the next section and next face;
- a cross-section on the line YY of FIG. 2 showing the consolidation 43 in the cast segment region of section B and the relative core face, plus the finished section A cast segments 34.
- a cross-section on the line ZZ of FIG. 2 showing the consolidation/tamping 43 of the section C in the future cast segment region.

With reference to FIGS. 8–14 showing the formation of a traditional vault tunnel with an inverted arch to be formed subsequently, FIG. 8 shows an apparatus 50 positioned with its axis at the centre of the tunnel to be formed, and comprising a load-bearing structure 51.

Said load-bearing structure 51 is provided with an arched guide 52 on which one or more heads with cutters 53 can slide. The arm 54 which carries the head with cutter 53 can be fitted with a further two supplementary heads 55 and 56 on respective guides 57 and 58 for the consolidation/tamping operation using the same sequence and method described for the machine used to construct a circular tunnel.

The apparatus shown in FIGS. 8–11 represents a modification of the previous apparatus mounted on a crawler-tracked self-propelled carriage. Both apparatus are arranged to allow free passage of the transport means 41 and the positioning of trays or collectors for the resultant material.

Figure 9:
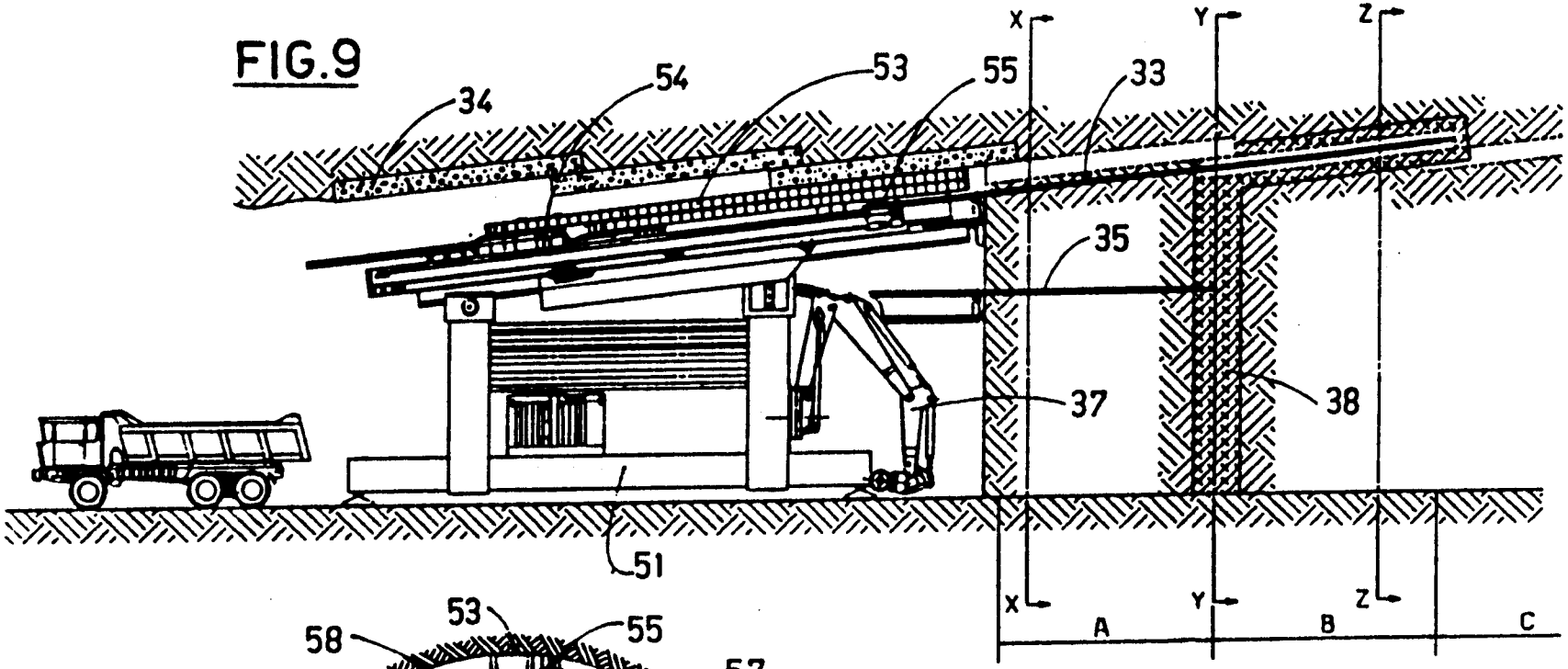
FIG. 9 is a longitudinal view of the apparatus of FIG. 8 during a working stage.
Figure 13:
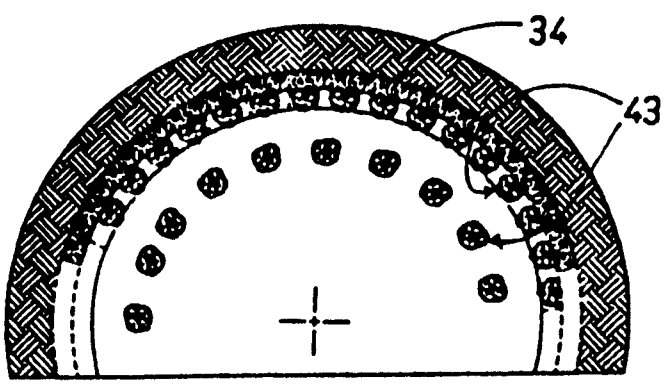
FIGS. 12, 13 and 14 are sections on the lines XX, YY and ZZ of FIG. 9 showing respectively the cast segments, and the consolidation/tamping injections in the subsequent cast segment and core regions.
Figure 14:
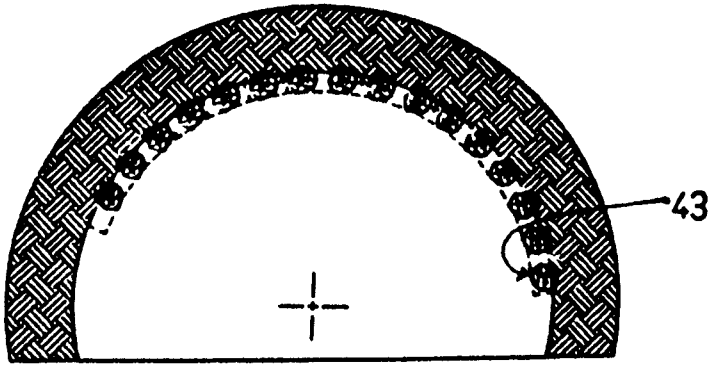
Figure 12:
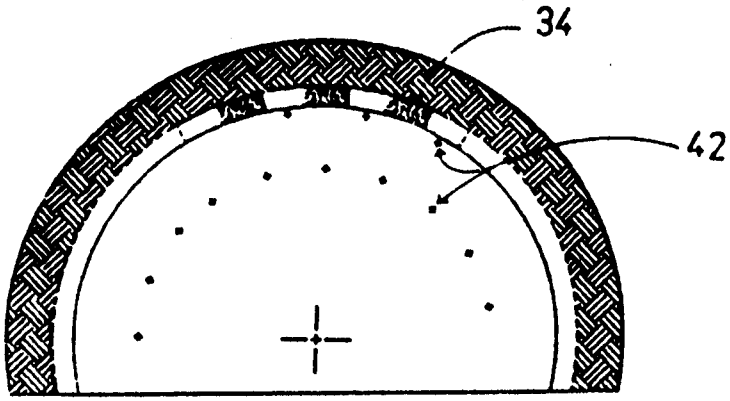

For greater clarity, FIGS. 12, 13 and 14 represent cross-sections on the lines XX, YY and ZZ of FIG. 9, showing the cast segments 34, the drilling rod passage bores 42, the consolidation/tamping injections 43 and the plugging of the core face 38, as described heretofore.

Figure 15:
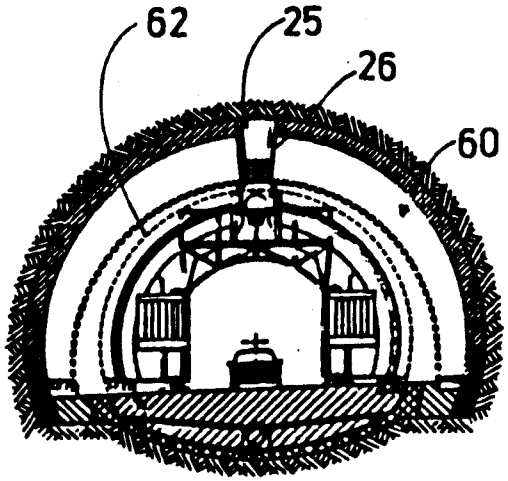
FIGS. 15 and 16 are respectively a front and longitudinal view of a apparatus for widening an existing tunnel.
Figure 16:
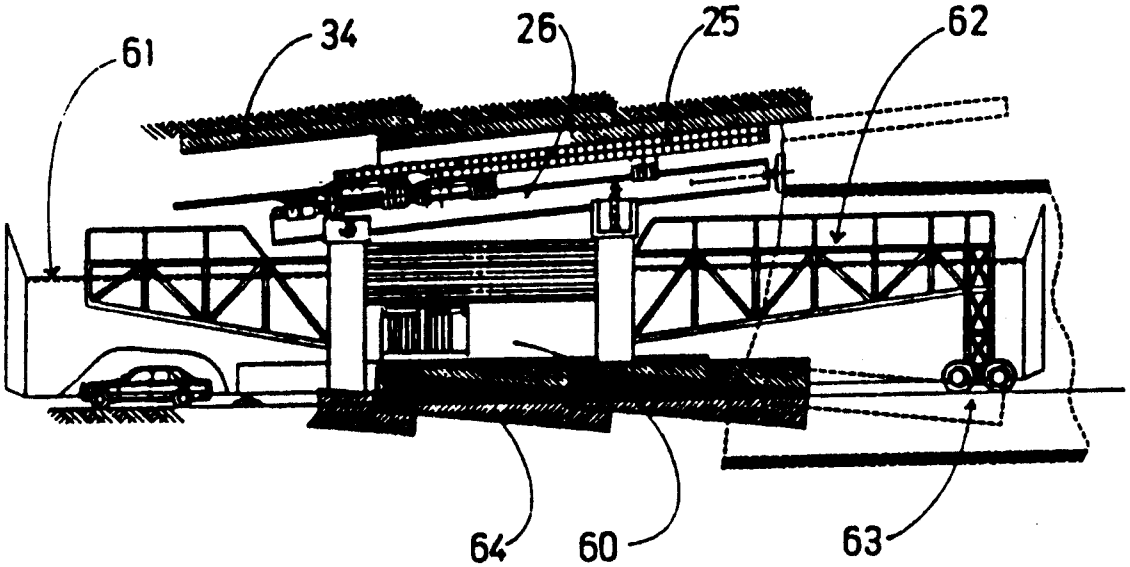

FIGS. 15 and 16 show an apparatus for widening existing tunnels (for example from two to three lanes). The concept is similar to that for forming traditional tunnels with an inverted arch to be formed subsequently. What is different is the machine load-bearing structure 60, which is of such construction and comprises such protection as to allow traffic to still pass, even if on a reduced scale. In this case, the cutter or cutter modules slidable on guides 26 for forming the cast segments 34 are not provided with supplementary heads for executing the consolidation/tamping and plugging, as the existing tunnel structure to be subsequently demolished should itself act as a support.

It is however possible to apply the drilling head for forming the consolidation/tamping in the region comprising the cast segments 34 to be formed, this system however not having been shown for simplicity.

This apparatus differs from the previously described apparatus by the presence of a protection screen 61, a working table 62 and self-propelled means 63 consisting of wheel-mounted carriages. This is because in this case the existing roadway can be used which together with the underlying inverted arch and tunnel foundations remains good.

A further characteristic of the widening process is the need to form inclined cast segments 64 at the roadway to connect the old inverted arch or its extension to the new larger vault. The machine is able to achieve this by virtue of its articulated connections and adjustment piston. These are not shown in the figure as they are already indicated in the cited patent application No. 3446 A/89.

In conclusion, again with reference to the preceding patent application, it is also possible to cast the cast segments with quick-setting concrete and/or concrete reinforced with metal fibres (fibre-reinforced concrete).

It is also possible to connect chain modules comprising teeth and/or knives to achieve different cast segment thicknesses and/or different shapes by which they are adjacently restrained.

I claim:

1. A method for forming a tunnel lining in which an apparatus, comprising at least one excavation tool of the chain, belt type, is positioned to be concentric to the longitudinal axis of the tunnel at a point on its extrados; the tool is made to advance to a predetermined depth in a direction diverging from the tunnel axis so as to create a substantially rectangular cavity from which the tool is withdrawn; said cavity is then filled with concrete to form a cast segment; the aforesaid stages are repeated until a frusto-conical section formed from adjacent cast segments is completed, after which the material enclosed by the formed section is excavated to a depth less than the axial length of the section, and the apparatus is advanced through a distance substantially equal to the axial length of the cast segments, the stages being repeated to form each successive section in order to form a lining in which the wider final portion of one section is superposed on the narrower initial portion of the next section, the method being characterized in that during the execution of one section of cast segments a second tool associated with said first tool executes consolidation/tamping injections with concrete into the region which is to constitute said next section.

2. A method as claimed in claim 1, characterised in that during the formation of a cast segment section, a third tool associated with said first and said second tool executes consolidation/tamping injections of concrete to form the core face which separates the end of the section in which cast segments are being formed from the beginning of the next section.

3. A tunnel lining apparatus comprising a unit for its advancement along the tunnel, means for supporting a frame on said advancement unit to enable the frame to rotate about the longitudinal axis of the tunnel and to move radially to said axis, at least one excavation tool mounted on said frame to slide in a longitudinal direction diverging from the tunnel axis and means for driving said tool along said frame, characterised in that associated with said excavation tool there is a second tool arranged to inject consolidation material into the next earth section to that in which said said first tool is excavating.

4. An apparatus as claimed in claim 3, characterised in that associated with said first and second tool there is a third tool arranged to inject consolidation material into the core face separating the end of the section in which said first tool is excavating from the beginning of the next section.

5. An apparatus as claimed in claim 3, characterised in that said second and said third tool consist of a drilling head mounted on a frame skid carrying said first tool; said drilling head being of the recoverable stem type with a disposable shoe and being hollow to allow consolidation material to be injected while extracting the head from the formed cavity.

* * * * *